US007883455B2

(12) United States Patent
Held et al.

(10) Patent No.: US 7,883,455 B2
(45) Date of Patent: Feb. 8, 2011

(54) FOLDING DEVICE WITH A FOLDING BLADE CYLINDER AND A FOLDING JAW CYLINDER

(75) Inventors: Michael Held, Heuchelheim (DE); Sebastian Alois Prüm, Kaiserslautern (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 170 days.

(21) Appl. No.: 12/310,885

(22) PCT Filed: Aug. 20, 2007

(86) PCT No.: PCT/EP2007/058597

§ 371 (c)(1),
(2), (4) Date: Mar. 11, 2009

(87) PCT Pub. No.: WO2008/031690

PCT Pub. Date: Mar. 20, 2008

(65) Prior Publication Data

US 2009/0318275 A1 Dec. 24, 2009

(30) Foreign Application Priority Data

Sep. 11, 2006 (DE) ..... 10 2006 042 592

(51) Int. Cl.
*B31B 1/56* (2006.01)

(52) U.S. Cl. ..... 493/454; 493/356; 493/359; 270/5.01; 270/20.1

(58) Field of Classification Search ..... 493/356, 493/359, 360, 454; 270/5.01, 8, 20.1
See application file for complete search history.

(56) References Cited

U.S. PATENT DOCUMENTS 5,242,367 A 9/1993 Marmin (Continued)

FOREIGN PATENT DOCUMENTS

DE 36 28 411 A1 2/1988

(Continued)

*Primary Examiner*—Hemant M Desai
(74) *Attorney, Agent, or Firm*—Jones, Tullar & Cooper, P.C.

(57) ABSTRACT

A folding device includes a folding blade cylinder and a cooperating folding jaw cylinder, each of which has several circumferentially arranged holding devices. These holding devices can be moved between a disengaged position, where the leading end of a product can be inserted or released, and a holding position in which the product leading edge is held in the holding device. The folding blade cylinder and the folding jaw cylinder each have a number of holding devices equal to the respective number of folding blades and folding jaws. Each of the folding blades presses a product to be folded, and which is held by one of the holding devices on the folding blade cylinder, into a cooperating folding jaw on the folding jaw cylinder. This is accomplished during the passage of the product through a transfer slot between the folding blade cylinder and the folding jaw cylinder. An offset between each folding blade and its associated holding device is adjustable. The location of a holding device, and a subsequent folding blade is fixed. The offset between one of the holding devices of the folding blade cylinder and one of the folding blades that follows that holding device is less than a maximum offset between one of the holding devices and the folding blade that follows behind the folding device.

20 Claims, 4 Drawing Sheets

U.S. PATENT DOCUMENTS

| | | | | |
|---|---|---|---|---|
| 5,417,642 | A * | 5/1995 | Boronka et al. | 493/425 |
| 5,494,270 | A * | 2/1996 | Laubscher | 270/49 |
| 5,520,378 | A * | 5/1996 | Kepert et al. | 270/8 |
| 5,522,586 | A * | 6/1996 | Bennett et al. | 270/8 |
| 5,547,452 | A | 8/1996 | Kepert et al. | |
| 5,765,459 | A * | 6/1998 | Hillebrand | 83/27 |
| 5,807,227 | A * | 9/1998 | Field | 493/424 |
| 6,251,053 | B1 * | 6/2001 | Lanvin et al. | 493/359 |
| 6,358,192 | B1 * | 3/2002 | Michalik | 493/424 |
| 7,115,087 | B2 * | 10/2006 | Held et al. | 493/428 |
| 7,351,189 | B2 * | 4/2008 | Stab | 493/432 |
| 7,569,007 | B2 * | 8/2009 | Thoma | 493/23 |
| 2007/0042888 | A1 * | 2/2007 | Prum | 493/432 |

FOREIGN PATENT DOCUMENTS

| | | | |
|---|---|---|---|
| DE | 43 42 037 | C1 | 3/1995 |
| DE | 44 12 142 | C2 | 10/1995 |
| EP | 0 531 648 | A1 | 3/1993 |
| GB | 2 288 167 | A | 10/1995 |

* cited by examiner

FOLDING DEVICE WITH A FOLDING BLADE CYLINDER AND A FOLDING JAW CYLINDER

CROSS-REFERENCE TO RELATED APPLICATIONS

This application is the U.S. national phase, under 35 U.S.C. 371, of PCT/EP 2007/058597, filed Aug. 20, 2007; published as WO 2008/031690 A1 on Mar. 20, 2008 and claiming priority to DE 10 2006 042 592.8, filed Sep. 11, 2006, the disclosures of which are expressly incorporated herein by reference.

FIELD OF THE INVENTION

The present invention is directed to folding apparatuses with a folding blade cylinder and a folding jaw cylinder. Each of the folding blade cylinder and the folding jaw cylinder is provided with holding devices. The folding blade cylinder is provided with a folding blade for each of its holding devices. A distance between each folding blade and its allocated holding device can be varied.

BACKGROUND OF THE INVENTION

A folding apparatus of this general type is known from DE 44 12 142 C2. This prior art device comprises a collecting cylinder, a folding jaw cylinder and a cutting unit which is located upstream of the collecting cylinder. The cutting unit is used to divide the web of material into the individual products. The collecting cylinder has a plurality of grippers to which the leading edge of a product is fed. The grippers press this leading edge of each such cut, individual product against the collecting cylinder, which will convey it further. To allow the grippers to pivot between a released position and a holding position, without damaging the products, the products must be offset from each other around the periphery of the collecting cylinder by an intermediate space in which the grippers are able to move. To provide this intermediate space, the peripheral speed of the collecting cylinder must be greater than the speed at which the web of material is fed into the folding apparatus.

The collecting cylinder described in DE 44 12 142 C2 is also equipped with a plurality of folding blades, which, when the folding apparatus is in fold production mode, extend each time they pass through a gap that is formed between collecting cylinder and folding jaw cylinder. Each of these folding blades press products that lie in front of them into a folding jaw of the folding jaw cylinder. The first cross fold, which is produced in this manner, is intended to divide the products at the center. It is thus necessary, when processing products of different lengths, to be able to vary the distance between grippers and folding blades on the collecting cylinder. To accomplish this result, grippers and folding blades are mounted on two different nested parts of the collecting cylinder, which two parts can be rotated counter to one another.

In fold production mode, the folding blades of the collecting cylinder must always meet with the folding jaws of the folding jaw cylinder at a transfer gap that is formed between the collecting cylinder and the folding jaw cylinder, in order to insert a product into the folding jaws of the folding jaw cylinder. The part of the collecting cylinder that holds the folding blades is therefore rigidly rotatably coupled to the folding jaw cylinder.

In book production mode, each of the grippers of the collecting cylinder passes through the transfer gap at the same time as does a gripper of the folding jaw cylinder. During such passage through the transfer gap, the gripper of the collecting cylinder pivots from a product end holding position to a product end released position. At the same time, the gripper of the folding jaw cylinder pivots from the released position to the holding position. A product is thus transferred from the collecting cylinder to the folding jaw cylinder without being cross folded, especially if the folding blades are also deactivated.

A circumferential distance between grippers and folding blades on the collecting cylinder is adjustable. The folding blades and the folding jaws must always pass through the transfer gap simultaneously, regardless of variations of this circumferential distance between grippers and folding blades on the collecting cylinder. As a result, the grippers of the collecting cylinder and those of the folding jaw cylinder are able to pass through the gap at different times. If a gripper of the folding jaw cylinder strikes a product, while that gripper is passing through the gap, the product will be damaged as a result of a pivoting movement of this gripper. To prevent this product damage, the gripper of the folding jaw cylinder must always strike an intermediate space on the collecting cylinder, between the products which are held on the collecting cylinder. For this reason, an angular distance between the grippers and the folding jaws of the folding jaw cylinder is chosen such that, when the distance between a gripper of the collecting cylinder and a gripper on the folding blade, that is interacting with a product being held by this gripper of the collecting cylinder is set to the greatest possible value, the grippers of the collecting cylinder and those of the folding jaw cylinder will pass through the gap between the two cylinders simultaneously. If the angular distance is adjusted to be smaller, the gripper of the folding jaw cylinder passes through the gap shortly before the gripper of the collecting cylinder. The gripper of the folding jaw cylinder can thus be prevented from colliding with a product on the collecting cylinder, as long as the intermediate space between the products on the collecting cylinder is large enough.

The intermediate space which is required for this purpose must be wider than the width of a space that is necessary merely to extend the grippers of the collecting cylinder. Its width typically measures approximately 6 cm. Assuming that each of the products is 50 cm in length, it follows that, to generate the necessary intermediate space, the speed at which the web of material is fed to the cutting unit must be 12% slower than the peripheral speed of the cylinders. However, the latter speed is limited due to the centrifugal forces that occur during revolution of the cylinders. Thus, the wider the required intermediate space, the slower the web must be fed in, and the lower is the resulting productivity. The shorter the products are, the less favorable is the ratio of web infeed rate to peripheral speed of the cylinders.

DE 43 42 037 C1 and DE 36 28 411 A1 both disclose folding apparatuses having variable cut-off lengths.

SUMMARY OF THE INVENTION

The object of the present invention is to provide folding apparatuses having a folding blade cylinder and a folding jaw cylinder.

The object is attained, in accordance with the present invention by the provision of a folding blade cylinder and a folding jaw cylinder, each of which are equipped with a plurality of circumferentially spaced holding devices. The folding blade cylinder is also provided with a folding blade associated with each of its holding devices. Similarly, the folding jaw cylinder is also provided with a folding jaw associated with each one of its holding devices. A circumferential distance between each folding blade and its associated holder can be varied. A distance between a holding device on the folding jaw cylinder, and its following folding jaw is fixed. The distance between a folding jaw cylinder holding device, and its associated holder, is less than a maximum distance between one of the holding devices on the folding blade cylinder and the folding blade that follows behind this holding device. This distance may be less than 20°.

The benefits to be achieved with the present invention consist, in particular that, when the folding apparatus is in the first production mode, the holding devices of the folding jaw cylinder pass through the transfer gap between the collecting cylinder and folding jaw cylinder in the holding position. Therefore, the holding devices are prevented from damaging products when they are passing through the transfer gap, even if one of these holding devices passes through the transfer gap at the same time as does a product.

The intermediate space between successive products on the collecting cylinder need be no larger than is required for the proper functioning of the holding devices of the collecting cylinder. The intermediate space therefore need be no wider than 30 mm. Its width is preferably at least 20 mm.

A conveyor belt device, for use in accelerating the products to the peripheral speed of the collecting cylinder, is preferably arranged between the cutting unit and the collecting cylinder.

The above-mentioned production mode, referred to hereinafter as a first production mode, is preferably a fold production mode, in which the products are transferred from the folding blades to the folding jaws. In a second production mode, which is also called a book production mode, the products are transferred, unfolded, from the holding devices of the collecting cylinder to the holding devices of the folding jaw cylinder.

The movement of the holding devices of the folding jaw cylinder is preferably controlled, in a generally known manner, by the provision of a cam disk, which has a depression that corresponds to the released position. In the first production mode, the holding devices of the folding jaw cylinder are prevented from tracing the depression or depressions in the cam disk.

To prevent the holding devices from tracing the depression or depressions in the cam disk, a cover plate, for use in covering the depression, is preferably arranged coaxially with and is rotatable in relation to the cam disk.

The distance between a holding device of the folding jaw cylinder and a folding jaw that follows behind this holding device, on the circumference of the folding jaw cylinder, is preferably fixed. This is done in order to keep the structure of the folding jaw cylinder simple. Moreover, this distance is preferably smaller than is the maximum distance between one of the holding devices on the circumference of the collecting cylinder and the folding blade that follows behind this holding device. Thus, the folding jaws and holding devices can be distributed approximately evenly around the circumference of the folding jaw cylinder, so that the need to retract the folding jaws creates no particularly troublesome compatibility conditions with regard to the structure of the holding devices, and vice versa.

It is preferably also possible to deactivate the folding blade, by the use of a fold controller for the folding blade cylinder, which is preferably provided. Deactivation of the folding blade, by the use of the control device for the folding blade, would not be possible without eliminating one of the production modes that are now preferably possible. A deactivation of the folding jaw systems is preferably unnecessary.

If sheet end grippers are to be used as holding devices, they will rest against the outside of a product when they are holding the product against a cylinder. In such a situation, in order to minimize a projection of the grippers beyond a rolling circle radius of the cylinder that supports them, it is expedient for the sheet end grippers to press the products against contact surfaces, each of which contact surfaces is located in a depression in the cylinder circumference. This applies especially to grippers of the folding jaw cylinder. As these grippers pass through the transfer gap formed between collecting cylinder and the folding jaw cylinder, it is possible for these grippers to come into contact with a product which is being held on the collecting cylinder.

BRIEF DESCRIPTION OF THE DRAWINGS

One preferred embodiment of the present invention is represented in the set of drawings, and will be specified in greater detail in what follows.

The drawings show in

DESCRIPTION OF THE PREFERRED EMBODIMENT

Figure 1:
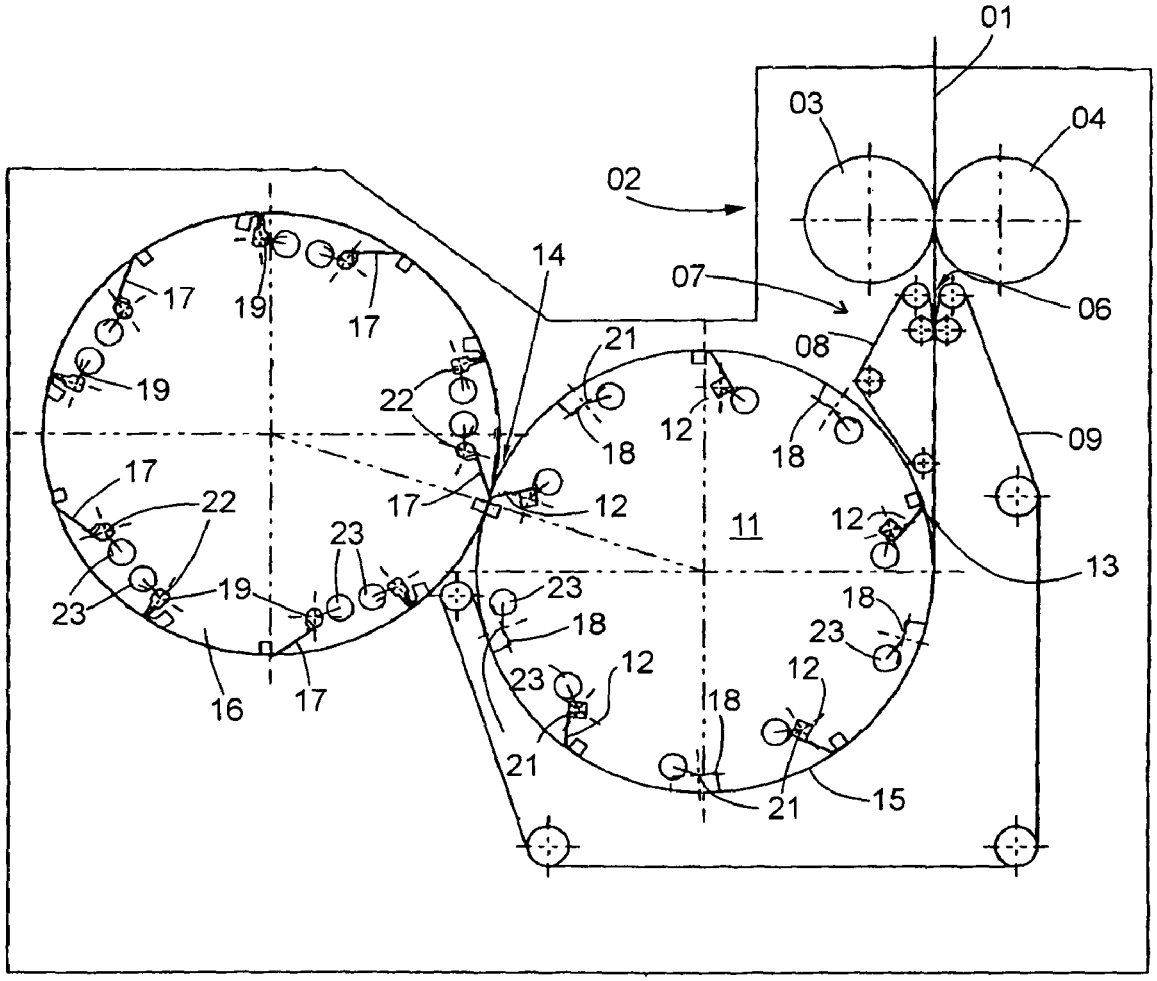
FIG. 1 a schematic side elevation view of a conventional folding apparatus.

Referring initially to FIG. 1, there may be seen a schematic depiction of a generally conventional folding assembly. Because the folding apparatus of the present invention, and which is preferably arranged in a web-fed rotary printing press, has many components in common with the conventional folding apparatus of FIG. 1, the conventional folding apparatus of FIG. 1 will first be described. The information provided in the discussion which follows, regarding the conventional folding apparatus of FIG. 1, will also apply to the folding apparatus in accordance with the present invention, unless otherwise stated or indicated in the context of that discussion.

An intake portion of the folding apparatus of FIG. 1 is formed by a cutting unit 02, which receives a printed web of material 01, such as, for example, a web of paper 01, from a superstructure, which superstructure is generally well known in the art and therefore is not represented in FIG. 1. The superstructure is typically configured having a plurality of guide rollers and turning bars, for example. The cutting unit 02 comprises a roller 03, such as, for example, a blade roller 03, which is equipped with a blade, and a roller 04, such as, for example, an impression roller 04, which is equipped with a hard rubber strip that forms an abutment for the blade. Blade roller 03 and impression roller 04 are rotationally driven at a peripheral speed that corresponds to the intake speed of the paper web 01. A plurality of blades can also be distributed evenly on the blade roller 03, and a cooperating number of abutments, which may preferably be provided as hard rubber strips, can be distributed evenly on the impression roller 04.

Since the diameters of the rollers 03; 04 must be increased, in proportion with the number of blades and/or strips which they each are provided with, an embodiment comprising one blade and one abutment is preferred.

The lead of the paper web 01, which is newly formed each time a product is cut off, enters into the junction 06 of a conveyor belt device 07, where it is clamped, at increasing depth and with increasing strength, between opposing belts 08; 09 of the conveyor belt device 07. The circulation speed of the belts 08; 09 is greater than the intake speed of the paper web 01, and corresponds to a peripheral speed of a folding blade cylinder 11, and particularly to the peripheral speed of a collecting cylinder 11, to which the products, which are separated from the paper web 01 by the cutting unit 02, are fed. The collecting cylinder 11 preferably has five holding devices 12, such as, for example, five sheet or product leading end grippers 12, and preferably also has five folding blades 18, each following behind an associated one of the grippers 12 at an adjustable distance. Rather than five such holding devices 12, three or seven of each may also be provided. At a point, which is identified in FIG. 1 as 13, the leading edges of the products are placed on the grippers 12 by the conveyor belt device 07, when the grippers 12 are in a holding position. When a gripper 12 reaches an area 15, by virtue of the continuing rotation of the collecting cylinder 11, it pivots open and the leading end of a product slips underneath it. The gripper 12 then pivots back into the holding position, pressing the product against the circumferential surface of the collecting cylinder 11. The product that is clamped in this manner is conveyed on the collecting cylinder 11 up to a transfer gap 14.

The folding apparatus depicted in FIG. 1 is usable in at least first and second production modes. In the first production mode, the folding blades 18 are operable and cross-fold the products, in cooperation with folding jaws 19 of a folding jaw cylinder 16. In the second production mode, the folding blades 18 and the folding jaws 19 are deactivated.

When the folding apparatus is operating in the second production mode, which preferably is a book production mode, the folding blades 18 on the collecting cylinder 11 are deactivated, and each gripper 12 of the collecting cylinder 11 strikes a holding device 17, such as, for example, a gripper 17 of a folding jaw cylinder 16, at the transfer gap 14, as is shown in FIG. 1. The collecting cylinder gripper 12 releases the product by pivoting outward, while the gripper 17 on the circumferential surface of the folding jaw cylinder 16 pivots inward into the holding position, thereby clamping the product securely against a contact surface. Such a contact surface is typically located at the base of a depression which is formed in the outer circumference of the folding jaw cylinder 16. The relevant product is thus transferred, unfolded, to the folding jaw cylinder 16. The distance between a gripper 17 of the folding jaw cylinder 16 and a corresponding folding jaw 19, that follows behind this gripper 17 on the circumference of the folding jaw cylinder 16, is smaller than 20°, and preferably is in the range of 15°±2.5°, viewed in the circumferential direction.

If, however, the folding apparatus is operating in the first production mode, which is referred to as the fold production mode, each gripper 12 on the collecting cylinder 11 first passes through the transfer gap 14 without opening. Only later, when the folding blades 18 and folding jaws 19, which follow respectively behind the grippers 12; 17 on the circumference of the collecting cylinder 11 and the folding jaw cylinder 16, meet one another, does the gripper 12 open. At that time, the folding blade 18 extends outward from the circumferential surface of the collecting cylinder 11, thereby pressing a product, which will now become folded at the center, into the folding jaw 19. The folding jaw 19 then closes to hold the product securely, and to convey the now-folded product further on the circumference of the folding jaw cylinder 16.

The movements of the grippers 12; 17, of the folding blades 18 and of the folding jaws 19 are all pivoting movements around axes 21; 22. These pivot axes 21; 22 are stationary in relation to the collecting cylinder 11 and folding jaw cylinder 16, respectively. The pivotal movements of the grippers 12; 17, the folding blades 18 and the folding jaws 19 are actuated via rollers 23, which rollers 23, in turn, trace cam disks which are coaxial in relation to the collecting cylinder 11 or folding jaw cylinder 16. The cam disks are stationary in relation to the collecting cylinder 11 and the folding jaw cylinder 16, and are not specifically shown in FIG. 1 as they are generally known in the art.

A cover plate, which is rotatable in relation to the axis of the collecting cylinder 11, and which is also generally known in the art and therefore also not specifically shown in FIG. 1, is allocated to each of the cam disks, which control the movement of the grippers 12 or of the folding blades 18 of the collecting cylinder 11. The circumference of that cover disk, like the circumference of the corresponding cam disk, is traced by the rollers 23 of the grippers 12 or of the folding blades 18. The cover disks enable collect and non-collect operation of the folding apparatus. They rotate at selectable speed ratios with respect to the speed of rotation of the collecting cylinder 11. In non-collect operation, the rotational speed of the cover disks can be adjusted to zero or to a first predetermined ratio to the rotational speed of the collecting cylinder 11. In non-collect operation, in each production mode, with each revolution of the collecting cylinder 11, the grippers 12 are allowed to open and close as they pass the location 15. In the case of book production mode, the grippers 12 also open as they pass through the transfer gap 14. In the case of fold production mode, the grippers 12 also open shortly after they pass through the transfer gap 14. The folding blades 18 are allowed to extend each time they pass through the transfer gap 14 in non-collect, fold production mode. In the case of collect production, the cover disks rotate at a second preset speed ratio, with respect to the rotational speed of the collecting cylinder 11. Every second time that the grippers 12, or the folding blades 18, when the folding apparatus is operating in fold production mode, pass through the transfer gap 14, their movement is prevented by the disks. The result is the product being held by the relevant grippers 12 again passes the point 13, where another product is placed upon it, and both products are then transferred, in collect production, together to the folding jaw cylinder 16.

As was previously mentioned above, the grippers 12 and the folding blades 18 are each held on a different one of two-nested, cooperating parts of the collecting cylinder 11. These two nested, cooperating parts of the collecting cylinder 11 can be rotated counter to one another to allow the distance between the grippers 12 and the folding blades 18 to be varied. FIG. 1 shows a configuration of the collecting cylinder 11 in which the distance between each gripper 12 and a folding blade 18, which can affect the product which is being held by the relevant gripper 12, is adjusted to the maximum possible value.

If, as is particularly the case in fold production mode, in which a length of the products which are to be processed is less than twice the distance between a gripper 12 and its allocated folding blade 18, this distance must be adjusted. The phase position of the grippers 12, in relation to the conveyor belt device 07, is left unchanged, so that, even after a suitable adjustment of the gripper and folding blade spacing, the leading edges of the products, which are being fed in by the conveyor belt device 07 can be gripped by the grippers 12. Instead, the phase position of the part of the collecting cylinder 11 that holds the folding blades 18 is changed with respect to the part of the collecting cylinder 11 that holds the grippers 12. The folding jaw cylinder 16 is rigidly rotatably coupled to this part of the collecting cylinder 11, which carries the folding blade 18 via a toothed gear unit. The result is that folding blades 18 and folding jaws 19 meet one another at the transfer gap 14 even after adjustment of the gripper 12 and blade 18 spacing. The result is that when the distance between gripper 12 and the allocated folding blade 18 on the collecting cylinder 11 is not at the maximum, each gripper 17 of the folding jaw cylinder 16 passes through the transfer gap 14 shortly in front of, or before a gripper 12 of the collecting cylinder 11 passes through transfer gap 14. To ensure that this folding jaw cylinder gripper 17 will not damage a product that is passing through the transfer gap 14 in collect operation without being transferred, the space between successive products on the collecting cylinder 11 must be large enough that the grippers 17 can extend through the transfer gap 14 without striking one of the products. In practice, this requires the provision of a space of approximately 6 cm in width between successive products on the collecting cylinder 11.

Figure 2:
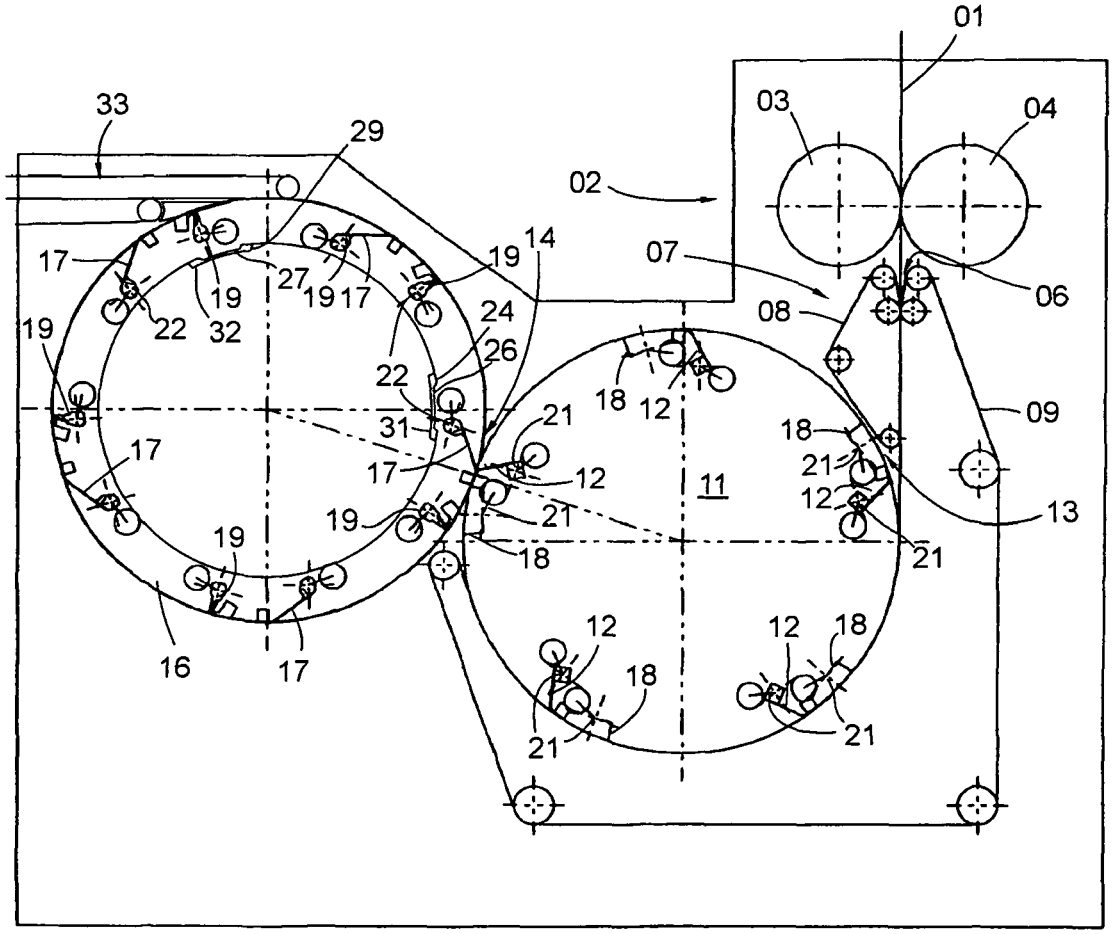
in FIG. 2 a side elevation view of the folding apparatus, analogous to FIG. 1, and adjusted to process shorter products.

FIG. 2 shows a side view of the folding apparatus in accordance with the present invention, in a representation which is generally analogous to that of FIG. 1. The movement of the grippers 17 of the folding jaw cylinder 16 is controlled via a cam disk 24, which is arranged coaxially in relation to the folding jaw cylinder 16 and which cam disk 24 is traced by the rollers 23 of the grippers 17. The cam disk 24 has two recesses 26; 27 on its circumference. One such recess 26 is located adjacent to the transfer gap 14. The second recess 27 is situated near the vertex of the cam disk 24. Coaxially to the cam disk 24 a cover disk 29 is provided. Cover disk 29 is rotatable in relation to the cam disk 24 and has recesses, two of which are identified here as 31; 32. In the configuration of the folding device, which is shown in FIG. 2, and which corresponds to the book production mode without collection, the distance between the grippers 12 and the folding blades 18 of the collecting cylinder 11 is adjusted to the minimum. Each gripper 12 of the collecting cylinder 11 meets a gripper 17 of the folding jaw cylinder 16 at the transfer gap 14. Moreover, the respective, cooperating recesses 26 and 31 and 27 and 32 respectively, of the can disk 24 and the cover disk 29, overlap one another, so that the rollers 23 of grippers 17 of the folding jaw cylinder 16 can trace the contours of the recesses 26; 27 of the cam disk 24 with each revolution. The dipping of the roller 23 of one of the grippers 17 into the recess 26 causes the relevant gripper 17 to pivot into the released position shortly before passing through the transfer gap 14, and to pivot into the holding position immediately after passing through the transfer gap 14. This is done in order to allow the gripper 17 on the folding jaw cylinder 16 to securely clamp a product that is released by a gripper 12 of the collecting cylinder 11, which gripper 12 is passing through the transfer gap 14 at the same time, against the folding jaw cylinder 16. The product is conveyed, in this manner, on the circumference of the folding jaw cylinder 16 until the gripper 17 dips into the recess 27 and pivots to the released position, thereby releasing the product, which remained unfolded, when transferred from the collecting cylinder 11 to the folding jaw cylinder 16 in the transfer gap 14. The released product is received by a conveyor belt device, which is identified as 33 and which is depicted in FIG. 2.

Shortly behind the grippers 12; 17, the folding blades 18, and folding jaws 19 which respectively are allocated to each of the folding blades 18, pass through the transfer gap 14. A cam disk, is arranged coaxially in relation to the collecting cylinder 11 and is provided for the purpose of controlling a release movement of the grippers 12 during passage through the transfer gap 14. A cover disk is allocated to the folding blades 18 in a known manner. The cover disk is oriented, in the operating mode shown in FIG. 2, such that it prevents the rollers 23 of the folding blades 18 from engaging in a recess of the cam disk which controls the release movement of the grippers 12. The cover disk of the folding blade 18 can be coupled with the location of the folding blade 18 on the collecting cylinder 11 in such a way that the folding blades 18 are automatically deactivated when the distance of the folding blades 18 from the grippers 12 is adjusted to the minimum. In this case, a folding operation, at this minimum distance, is excluded. Alternatively, control assemblies can be provided that will deactivate the folding blades 18 independently of their distance from the grippers 12. This configuration allows folding operation, even with the minimum spacing.

A cam disk and a cover disk could also be allocated to the folding jaws 19 for the purpose of controlling their movement. However, the cover disk of such an assembly can also be omitted, as in book production mode it is not necessary to prevent the movement of the folding jaws 19 for the folding apparatus to function properly. Preferably, the folding jaws 19 are arranged so as to open and close in all production modes. In other words, they cannot be deactivated.

The folding apparatus in accordance with the present invention also supports book production modes, with collection. In a first such book production mode with collection, the supplied paper web 01 is divided into products in the cutting unit 02. A length of each such product corresponds to ½ the circumference of a printing cylinder, and of a printing plate in the printing couple which is arranged upstream of the folding apparatus. If two different printing plates are mounted on a printing cylinder of the printing couple, two different printed pages can be generated alternatingly. These two different printed pages are then assembled via single collect operation in the folding apparatus to produce a printed product. Single collect operation requires that the grippers 12 of the collecting cylinder 11 open each time they pass the point 13 and alternatingly either open or remain closed when they are passing through the transfer gap 14, in a generally known process. Combinations of cam disks and cover disks, which enable such an operation, are known in the art and do not need to be described at this point. To ensure that products passing through the transfer gap 14, and remaining on the collecting cylinder 11 during collect production, are not gripped by the grippers 17 of the folding jaw cylinder 16 and damaged, by being held securely by the grippers 12 and 17 at the same time, it is necessary, in single collect operation, to also implement a control of the grippers 17, which control will prevent the grippers 17 from moving with every second passage of these grippers 17 through the transfer gap 14. A cam disk/cover disk combination, which provides this operation, can be structured substantially analogous to that of the collecting cylinder 11 and is therefore not represented here in detail.

In a second, double collect book production mode, the supplied paper web 01 is divided into products in the cutting unit 02, with the length of each product corresponding to one-third the circumference of a printing cylinder, especially to one-third of the circumference of a forme cylinder of a printing couple which is located upstream. In other words, one of two printing plates that are mounted on the printing cylinder contains pages a1, a2, b1 and the other contains pages b2, c1, c2, and the cutting unit 02 supplies products containing pages a1, a2 or b1, b2 or c1, c2, respectively. These products, which are shorter than those of the first collect book production mode, are greatly accelerated in the conveyor belt device 07, so that each of them strikes a gripper 12 of the collecting cylinder 11. A combination of cam disk and cover disk suitable for this purpose is generally known in the art and will not be described in detail here. A corresponding combination is also provided on the folding jaw cylinder 16, to ensure that each of its grippers 17 passes through the transfer gap 14 twice in the closed position, and grips the collected products, which are then released by the collecting cylinder 11, only during its third passage through the transfer gap 14.

Figure 3:
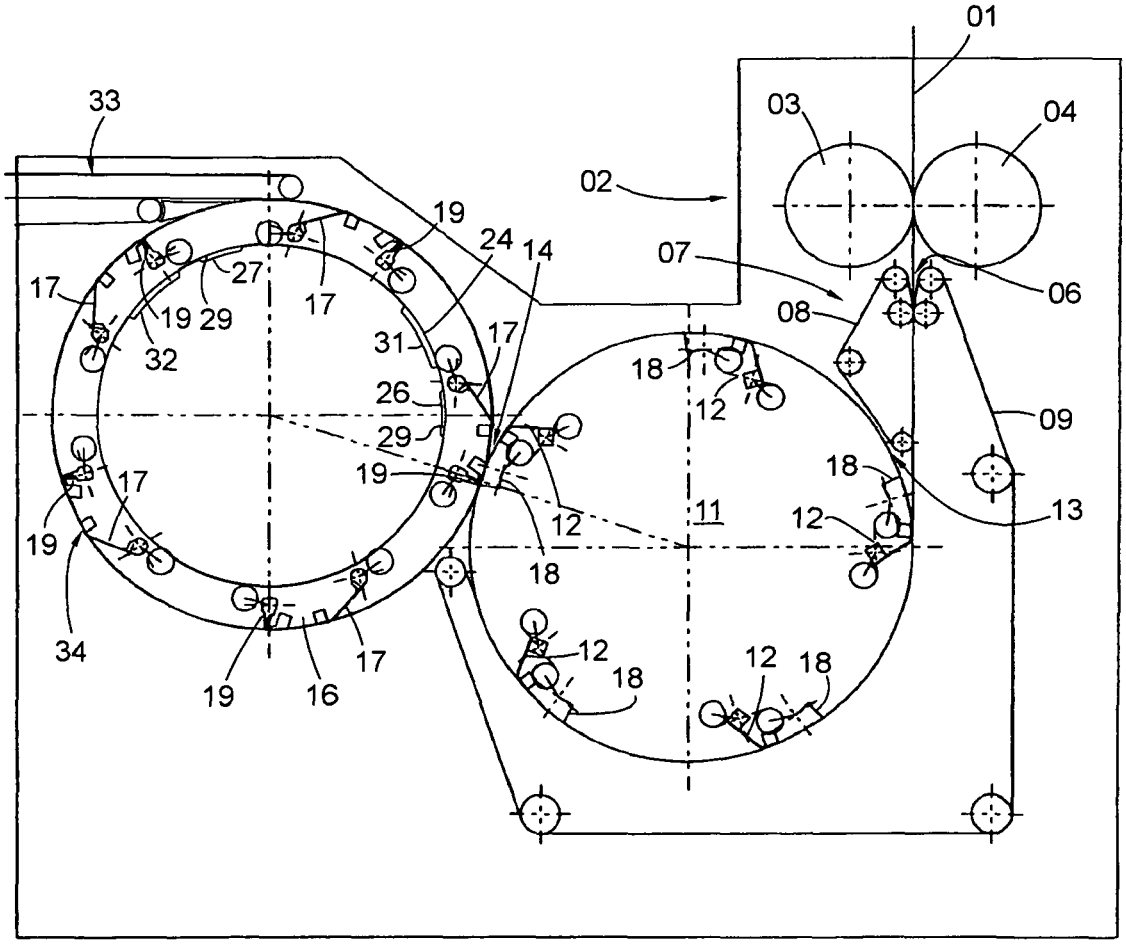
in FIG. 3 a second side elevation view of the folding apparatus of FIG. 2 at a slightly later point in time; and in FIG. 4 a side elevation view of the folding apparatus, adjusted to process longer products.

FIG. 3 shows the folding apparatus, in accordance with the present invention, in fold production mode. The relative phase positions of the part of the collecting cylinder 11 that holds the grippers 12 and the part of the collecting cylinder 11 that holds the folding blades 18, or the folding jaw cylinder 16, are the same as was the case in the configuration of FIG. 2. Shown in FIG. 3 is a moment in the operational sequence which a folding blade 18 and a folding jaw 19 are both passing through the transfer gap 14. The folding blade 18 is pressing a product, that has just been released by the adjacent associated gripper 12, into the folding jaw 19. In this operating mode, the cover disk 29 is rotated, in relation to the cam disk 24, so that the recesses 26; 31 and 27; 32 respectively of the cam disk 24 and the associated cover disk 29 never overlap one another. The grippers 17 of the folding jaw cylinder 16 are thus completely deactivated. In each case, the folding jaws 19 close shortly after passing through the transfer gap 14 and open at a transfer point 34. Products, that have been inserted by the folding blades 18 into the folding jaws 19 at the transfer gap 14, are conveyed past the conveyor belt device 33 and are conveyed up to the transfer point 34. At this transfer point 34, the products are received by another conveyor belt device, which is not shown in FIG. 3, which separate, not depicted conveyor belt device delivers them to a paddle wheel, which, in turn, places them, in a stream, on a conveyor belt.

Figure 4:
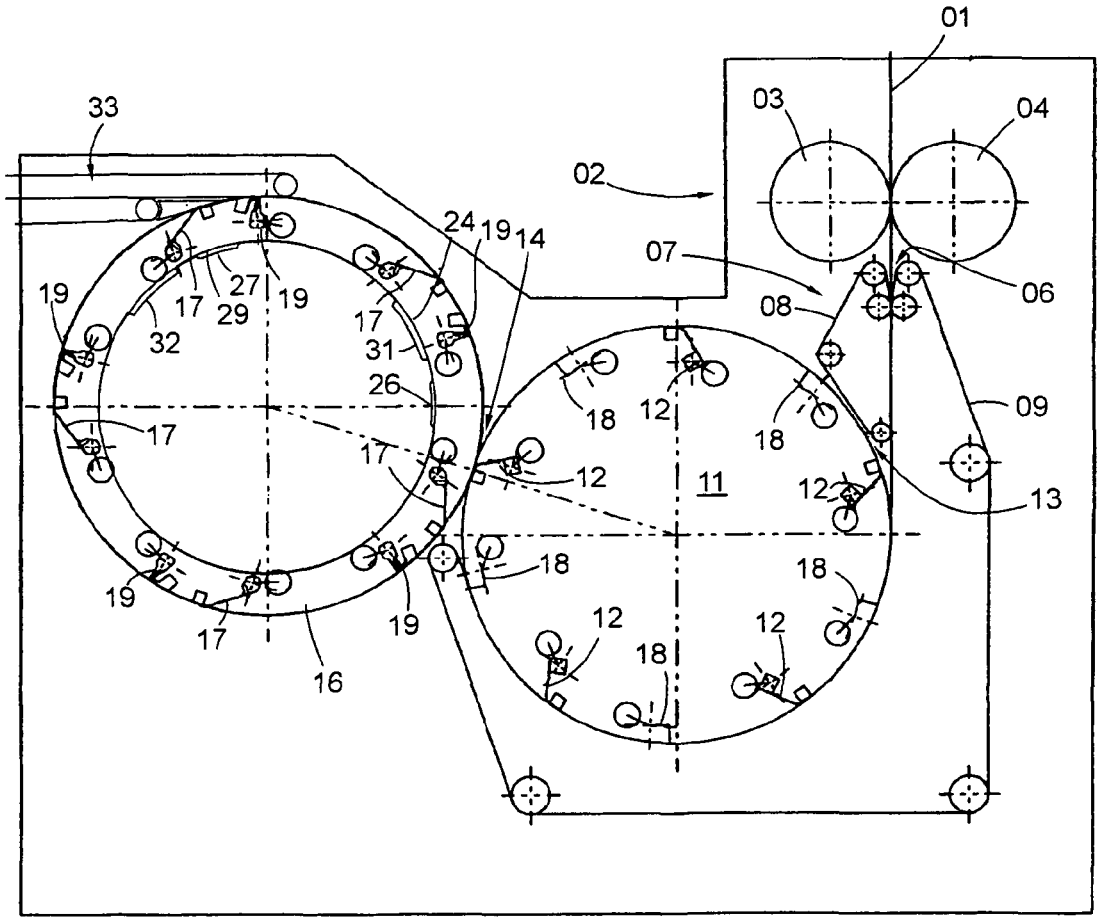

FIG. 4 shows the folding apparatus, in accordance with the present invention, again in a fold production mode, but in this configuration adjusted to process products of greater length than those depicted and discussed in the configuration of FIG. 3. To adjust to these greater length products, the distance between the grippers 12 and the folding blades 18 which are allocated to each of them on the collecting cylinder 11 is increased. This distance is now greater than the fixed distance between each gripper 17, and the folding jaw 19 which is allocated to it, on the folding jaw cylinder 16. Thus, each of the folding jaw cylinder grippers 17 pass through the transfer gap 14 behind a collecting cylinder gripper 12, and in front of, or before the folding blade 18 which is allocated to this collecting cylinder gripper, simultaneously with a product that is held by the gripper 12. However, because the cover disk 29 is covering the recess 26 of the cam disk 24, as was already discussed and depicted in connection with FIG. 3, the gripper 17 remains immovably in the holding position as it passes through the transfer gap 14, and does not come into contact with the product that is passing through the transfer gap 14 at the same time. Thus, for the intermediate spacing between successive products on the collecting cylinder 11, it is necessary to provide only as much space as is required for the proper functioning of its grippers 12. This distance is typically 25 mm. To achieve this spacing, and assuming that the products are 50 cm in length, the conveyor belt device 07 and the collecting cylinder 11 need to travel only 5% faster than the intake speed of the paper web 01. In significant contrast, an intermediate space of 6 cm, as was required in prior devices, requires a speed difference of 12%. This means that if the collecting cylinder 11 and the folding jaw cylinder 16 are rotating at a maximum speed, which is typically determined by their structure, the folding assembly in accordance with the present invention allows the paper web 01 to run 7% faster, thereby increasing productivity by the same percentage. Furthermore, due to the reduced or decreased difference between the intake speed of the paper web 01 into the cutting unit 02, and the travel speed of the conveyor belt device 07, the danger that the leading end of the paper web 01, which is becoming engaged in the conveyor belt device 07 but which has not yet been cut off from the rest of the web by the cutting unit 02, will be damaged, as a result of friction against the belts 08; 09, is decreased.

The grippers 17 of the folding jaw cylinder 16 are allowed to pass through the transfer gap 14, together with a product being held by a gripper 12 of the collecting cylinder 11. In the folding jaw cylinder 16 shown in FIG. 4, the grippers 17 and the folding jaws 19 are distributed approximately evenly around the circumference of the folding jaw cylinder 16. This results in an open arrangement of grippers 17 and folding jaws 19, which makes it easy to configure them so as to prevent their mutual functional disruption, and so as to ensure their easy access for repairs.

In fold production mode, as depicted in FIGS. 3 and 4, a suitable configuration of cam disks and cover disks, that is generally known in the art, also enables single or double collection wherein the folding blades 18 extend, to insert the products into the folding jaws 19, only with every second or third passage of the folding blades 18 through the transfer gap 14. An analogous control of the folding jaws 19, which causes them to open and close only with every second or third passage through the transfer gap 14, is conceivable, but is not absolutely necessary for the proper functioning of the folding apparatus.

The above-described configuration of the folding apparatus, in accordance with the present invention, facilitates a high level of productivity in both book production mode and fold production mode. Products having a page length that does not cover the entire circumference of the collecting cylinder 11 can also be produced economically. The possibility of producing three products from two printing plate lengths, and of employing single or double collection as needed, increases the flexibility of the apparatus substantially.

While preferred embodiments of the folding apparatuses with a folding blade cylinder and a folding jaw cylinder, in accordance with the present invention, have been set forth fully and completely, it will be apparent to one of skill in the art that changes in, for example, the drives for the cylinders, the types of web being folded, the product delivery devices, and the like could be made without departing from the true spirit and scope of the present invention which is accordingly to be limited only by the following claims.

What is claimed is:

1. Folding apparatus with a folding blade cylinder (11) and a folding jaw cylinder (16), wherein the folding jaw cylinder (16) and the folding blade cylinder (11) are each equipped with a plurality of holding devices (17; 12) in the circumferential direction, wherein the holding devices (17; 12) can be moved between a released position, for receiving and releasing a leading edge of a product, and a holding position, in which the leading edge is held on the holding device (17; 12), wherein the folding jaw cylinder (16) also has a folding jaw (19) for each of its holding devices (17), and the folding blade cylinder (11) has a folding blade (18) for each of its holding devices (12) for the purpose of pressing a product that is being held by the holding device (12) allocated to the folding blade (18) into one of the fording jaws (19) as it passes through a transfer gap (14) between folding blade cylinder (11) and folding jaw cylinder (16), and wherein the distance between each folding blade (18) and its allocated holding device (12) on the fording blade cylinder (11) can be adjusted, wherein the distance between a holding device (17) of the folding jaw cylinder (16) and a folding jaw (19) that follows behind this holding device (17) on the circumference of the folding jaw cylinder (16) is fixed, characterized in that the distance between a holding device (17) of the fording jaw cylinder (16) and a folding jaw (19) that follows behind this holding device (17) on the circumference of the folding jaw cylinder (16) is smaller than the maximum distance between one of the holding devices (12) on the circumference of the folding blade cylinder (11) and the folding blade (18) that follows behind this holding device (12).

2. Folding apparatus in accordance with claim 1, characterized in that a cutting unit (02) is provided for dividing a web of material (01) into individual products.

3. Folding apparatus in accordance with claim 2, characterized in that a conveyor belt device (07) is arranged between the cutting unit (02) and the folding blade cylinder (11) for the purpose of accelerating the products.

4. Folding apparatus in accordance with claim 2, characterized in that the peripheral speed of the folding blade cylinder (11) is linked to the speed of the material web (01) in the cutting unit (02).

5. Folding apparatus in accordance with claim 1, characterized in that the folding jaws (19) are arranged so as to open and close in all production modes.

6. Folding apparatus in accordance with claim 1, characterized in that the folding jaws (19) are arranged so that they cannot be deactivated.

7. Folding apparatus in accordance with claim 1, characterized in that an intermediate space no more than 30 mm in width is provided between successive products held on the folding blade cylinder (11).

8. Folding apparatus in accordance with claim 7, characterized in that the intermediate space is at least 20 mm in width.

9. Folding apparatus in accordance with claim 1, characterized in that in a first production mode the holding devices (17) of the folding jaw cylinder (16) are arranged so as to pass through the transfer gap (14) between folding blade cylinder (11) and folding jaw cylinder (16) in the holding position.

10. Folding apparatus in accordance with claim 9, characterized in that the first production mode is single collect production.

11. Folding apparatus in accordance with claim 10, characterized in that a third production mode is double collect production.

12. Folding apparatus in accordance with claim 11, characterized in that in double collect production the products, downstream of a cutting unit (02), each correspond to the length of one-third of a circumference of a forme cylinder of a printing couple arranged upstream of the folding apparatus.

13. Folding apparatus in accordance with claim 10, characterized in that in single collect production, the products, downstream of a cutting unit (02), each correspond to a length of one-half the circumference of a forme cylinder of a printing couple arranged upstream of the folding apparatus.

14. Folding apparatus in accordance with claim 1, characterized in that a first production mode is a fold production mode, which transfers the products from the folding blades (18) to the folding jaws (19).

15. Folding apparatus in accordance with claim 14, characterized in that the movement of the holding devices (17) of the folding jaw cylinder (16) is controlled by a cam disk (24), which has a recess (26) that corresponds to the released position, and in that in the first production mode the holding devices (17) of the folding jaw cylinder (16) are prevented from tracing said recess (26).

16. Folding apparatus in accordance with claim 15. characterized in that a cover disk (29) for covering the recess (26) is arranged coaxially and rotatably in relation to the cam disk (24).

17. Folding apparatus in accordance with claim 14, characterized in that in the first production mode, i.e., cross-fold production, in which the products are transferred from the folding blades (18) to the folding jaws (19). a distance of the holding device (17) allocated to the folding jaw (19) is equal to or smaller than a distance of the holding device (12) allocated to the folding blade (18).

18. Folding apparatus in accordance with claim 1, characterized in that in a second production mode the holding devices (12) of the folding blade cylinder (11) are arranged so as to transfer the products, unfolded, to the holding devices (17) of the folding jaw cylinder (16).

19. Folding apparatus in accordance with claim 1, characterized in that the folding blade cylinder (11) is embodied as a collecting cylinder (11).

20. Folding apparatus in accordance with claim 1, characterized in that that a distance between a holding device (17) of the folding jaw cylinder (16) and a folding jaw (19) that follows behind this holding device (17) on the circumference of the folding jaw cylinder (16) is smaller than 20°.

* * * * *